US005215249A

United States Patent [19]

Gorrieri

[11] Patent Number: 5,215,249

[45] Date of Patent: Jun. 1, 1993

[54] TUBULAR CONTAINER, PARTICULARLY FOR FOOD PRODUCTS

[75] Inventor: Giordano Gorrieri, Pianoro, Italy

[73] Assignee: Azionaria Construzioni Macchine Automatiche A.C.M.A. S.p.A., Bologna, Italy

[21] Appl. No.: 984,012

[22] Filed: Nov. 30, 1992

Related U.S. Application Data

[63] Continuation of Ser. No. 726,666, Jul. 8, 1991, abandoned.

[30] Foreign Application Priority Data

Jul. 24, 1990 [IT] Italy ..... 3613 A/90

[51] Int. Cl.[5] ..... B65D 65/00

[52] U.S. Cl. ..... 229/87.05; 229/87.08; 229/926; 383/205

[58] Field of Search ..... 229/87.05, 87.08, 926; 383/205, 206

[56] References Cited

FOREIGN PATENT DOCUMENTS 0109353 5/1984 European Pat. Off. .

*Primary Examiner*—Stephen P. Garbe

*Attorney, Agent, or Firm*—Guido Modiano; Albert Josif

[57] ABSTRACT

Tubular obtained from a sheet which has, on its inner surface, in contact with a product to be wrapped, two longitudinal bands which are coated by a layer of cold-adhesive; the two longitudinal bands are glued to one another with the interposition of an end portion of a tear-strip, the opposite surfaces whereof are coated by respective layers of cold-adhesive.

3 Claims, 2 Drawing Sheets

Fig. 3
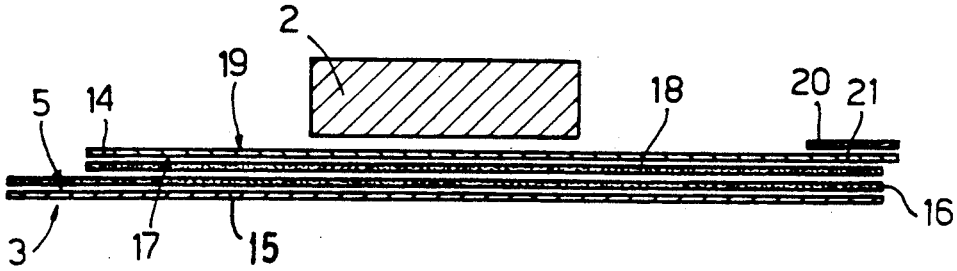
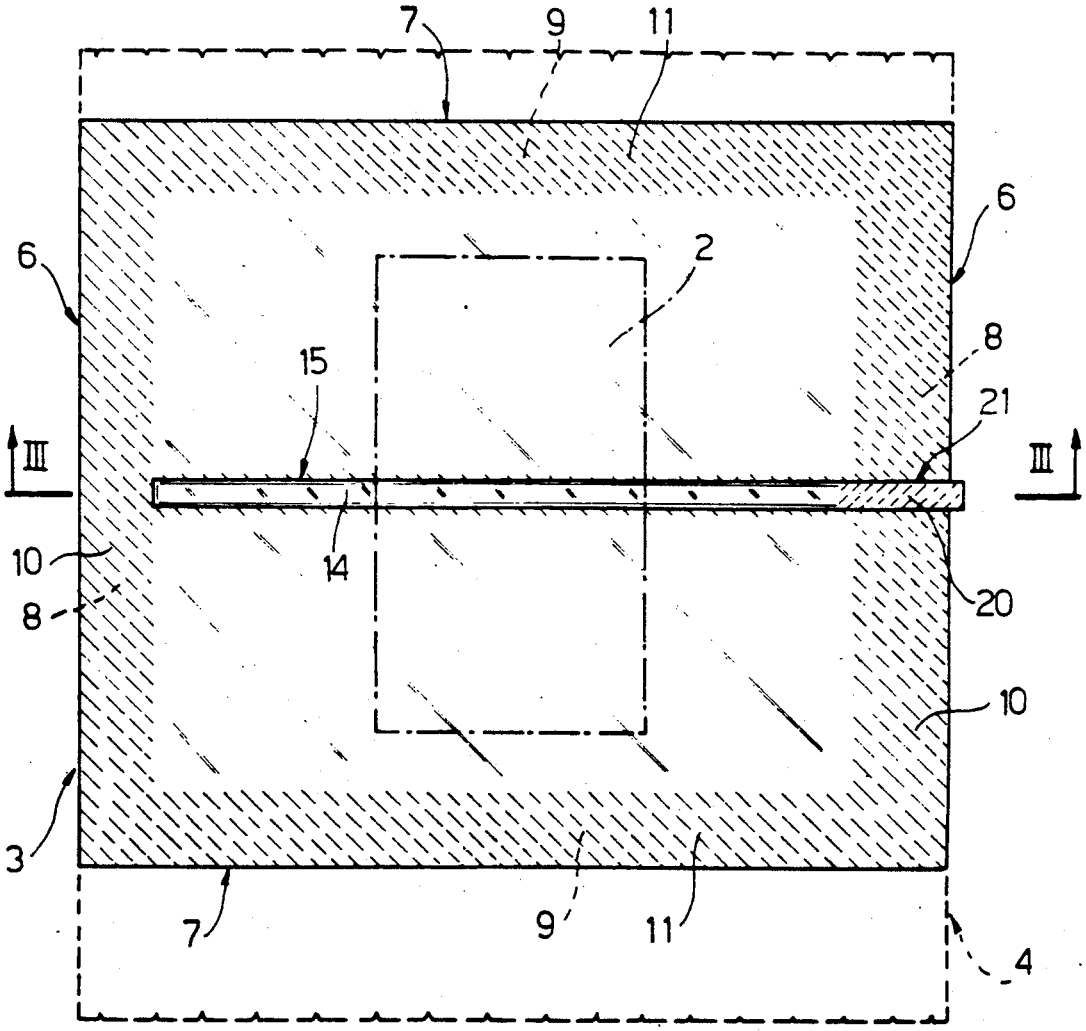
Fig. 2

TUBULAR CONTAINER, PARTICULARLY FOR FOOD PRODUCTS

This is a continuation application of application Ser. No. 07/726,666 filed on Jul. 8, 1991, now abandoned.

BACKGROUND OF THE INVENTION

The present invention relates to a tubular container particularly for food products.

In the field of food products it is known to use, especially for packaging products which have a generally parallelepipedal shape, so called tubular wrappings, which are manufactured starting from a continuous band, one surface of which, hereinafter indicated as "inner surface", is suitable for making contact with the products to be wrapped and has two peripheral longitudinal regions covered by respective layers of heat-weldable adhesive material.

Generally, said products are packaged by arranging them in succession in contact with the inner surface of the band, which is then folded transversely until the layers of adhesive material of said two peripheral longitudinal regions are moved into mutual contact so as to define, once they are subjected to a heat-welding operation, a continuous tubular container which is laterally provided with a flap which is constituted by the mutually welded opposite longitudinal edges of the band.

Said continuous tubular container is subsequently cut in portions which are welded at their ends and have a preset length; each portion defines a tubular fluid-tight wrapping for a related product.

For many food products packaged in the above described manner it is necessary to produce said wrappings so that they are particularly easy to open and so that their opening does not entail the complete destruction of said wrappings, a part of which must remain preferably intact and protect the related products until they are eaten.

This need is normally met by transversely applying, on each wrapping, a tear-strip which allows to easily divide said wrapping into two parts. In order to allow the opening of the wrapping, the strip has one end which extends outside said mutually welded longitudinal edges of the band.

Generally, said strips are constituted by, or covered with, heat-weldable material, so as to initially allow their application onto the continuous band by means of a heat-welding operation and subsequently, by means of a second lo previously mentioned heat-welding operation, so as to allow the execution of the tubular container, which affects not only the longitudinal edges of the continuous band but also the end of the strips which is interposed between said longitudinal edges.

The above described known tubular wrappings have the disadvantage of requiring, for their manufacture, a succession of operations involving heat, which can entail a deterioration of the packaged products.

SUMMARY OF THE INVENTION

The aim of the present invention is to provide a tubular container which does not require operations involving heat for its manufacture.

According to the present invention, a tubular container particularly for food products is provided which comprises a portion of sheet material having an inner surface arrangeable in contact with a related product, two longitudinal edges and two transverse edges, a layer of adhesive material applied on a band of said inner surface which extends along each of said edges, and a tear-strip which extends in contact with said inner surface transversely to said longitudinal edges, said sheet being folded so as to move into mutual contact both the two inner surface bands arranged along the longitudinal edges, with the interposition of an end portion of said strip, and the two inner surface bands which are arranged along the transverse edges, characterized in that said adhesive material is a cold-adhesive material, a first further layer of cold-adhesive material coating a first surface of said strip which faces said inner surface, and a second further layer of cold-adhesive material coating at least one portion of a second surface of said strip which is opposite to said first surface, said portion of second surface extending along said end portion of said strip.

Preferably, a layer of cold-adhesive material is applied on a portion of said inner surface which is arranged in contact with said first surface of said strip.

BRIEF DESCRIPTION OF THE DRAWINGS

The present invention will now be described with reference to the accompanying drawings, which illustrate a non-limitative example of an embodiment thereof, wherein:

FIG. 2 is a plan view of a development of the wrapping of FIG. 1; and

FIG. 3 is a sectional view taken along the line III—III of FIG. 2.

DESCRIPTION OF THE PREFERRED EMBODIMENTS

Figure 1:
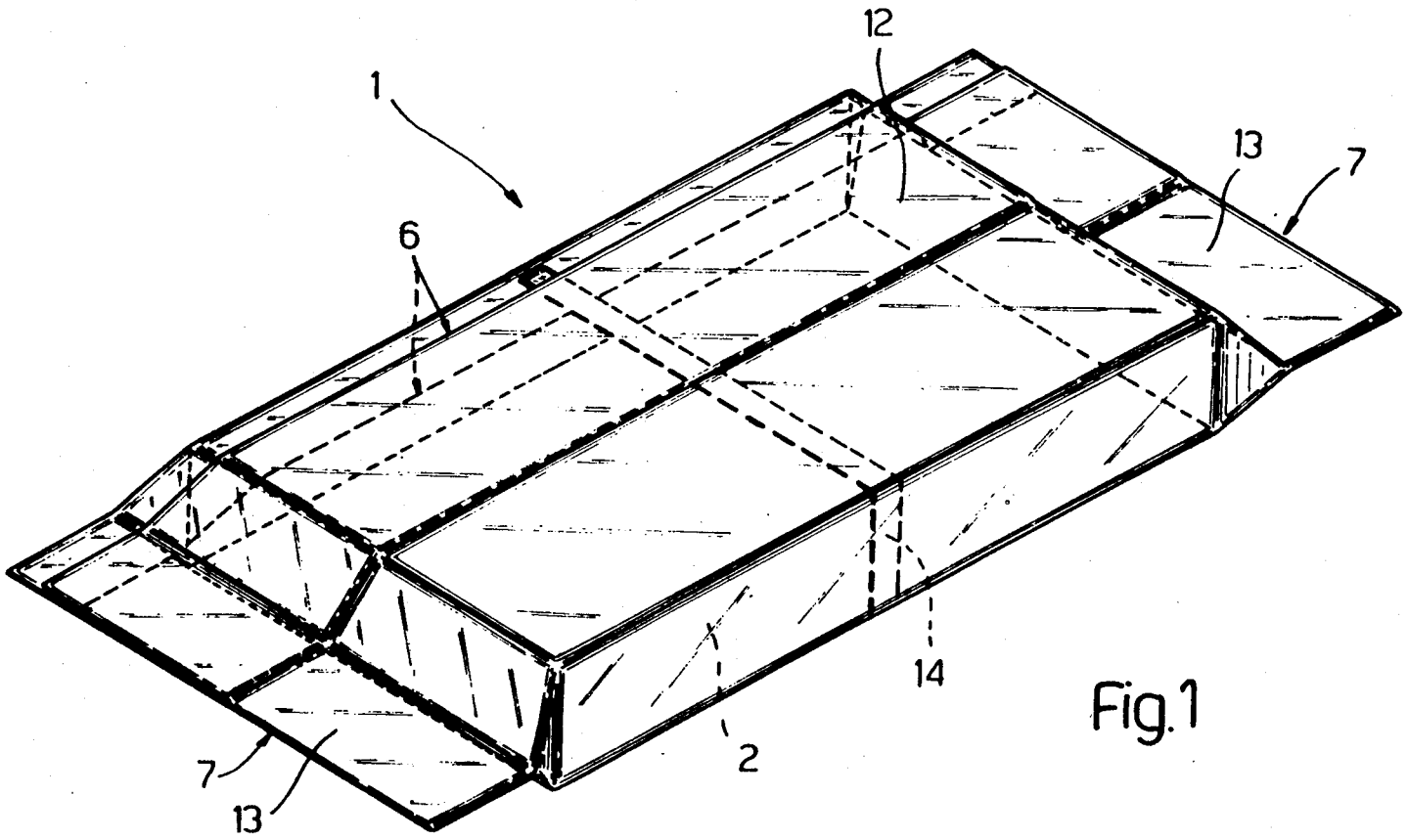
FIG. 1 is a perspective view of a preferred embodiment of the container according to the invention.

With reference to FIG. 1, the reference numeral 1 generally indicates a tubular and substantially "pillow-shaped" container or wrapping for a product 2 (FIGS. 2 and 3), particularly a food product, having a substantially parallelepipedal shape.

According to what is illustrated in FIG. 2, the container 1 is manufactured starting from a planar rectangular sheet 3 obtained by transversely cutting a continuous band 4, and has an inner surface 5 (FIG. 3) which can be arranged in contact with a related product 2 and is delimited by two longitudinal edges 6 and by two transverse edges 7. Bands 8 and 9 of the inner surface 5 which extend along the edges 6 and 7 respectively are coated with respective layers 10 and 11 of cold-adhesive material.

The container or wrapping 1 is manufactured by folding the sheet 3 around the product 2 so as to move the two bands 8, and the adhesive layers 10 which coat them, into contact with one another so as to mutually connect them and form a flap 12 which, according to what is illustrated in FIG. 1, extends in a longitudinal direction outside said container 1 and is folded into contact with an outer surface of the sheet 3. The container 1 is then completed by making the layers 11, arranged along the mutually facing transverse bands 9, adhere to one another so as to form two transverse flaps 13.

If, as in the illustrated example, the sheet 3 is part of a continuous band 4, the operation of mutually glueing the layers 11 and of forming the flap 13 is performed simultaneously with an operation of transverse cutting of said band 4.

According to what is illustrated, in particular, in FIG. 2, the container 1 furthermore comprises a tear-strip 14 which extends in contact with an intermediate band 15 of the inner surface 5 of the sheet 3 transversely to the longitudinal edges 6. According to what is more clearly illustrated in FIG. 3, the intermediate band 15 is preferably but not necessarily coated with a layer 16 of cold-adhesive material. The strip 14 has a length at least equal to the distance comprised between an inner edge of one of the two longitudinal bands 8 and the longitudinal edge 6 which is opposite thereto, and the strip 14 is arranged so as to extend through one of the longitudinal bands 8 and be secured between said two bands 8 during the formation of the flap 12.

According to what is illustrated in FIG. 3, the strip 14 has a first surface 17, which is arranged in contact with the band 15 of the inner surface 5 of the sheet 3 and is coated with a layer 18 of cold-adhesive material, and a second surface 19, which is opposite to the surface 17 and is at least partially coated by a layer 20 of cold-adhesive material. In particular, said layer 20 extends, as in the illustrated example, to a portion of the surface 19 which extends along an end portion 21 of the strip 14 which is superimposed on one of the bands 8.

From the above description it can be deduced that the described container 1 can be obtained without performing any operation involving heat and that the container 1 is furthermore a perfectly fluid tight container, as normally required by hygiene rules related to the packaging of food products. The presence of the layer 20 of cold-adhesive material, at least on the portion of the surface 19 which extends to the end portion 21 of the strip 14, ensures the perfect closure of the wrapping 1 along the flap 12. On this subject it should be stressed that one of the disadvantages normally occurring in cold-adhesives is that they do not ensure tightness unless glueing between two opposite adhesive layers is performed. Consequently, the wrapping 1 would not be perfectly fluid-tight if the layer 20 were missing.

The optional presence of the layer 16 along the intermediate band 15 of the surface 5 ensures the perfect adhesion of the strip 14, along its entire length, to the sheet 3 and, accordingly, a clear-cut splitting of the wrapping 1 into two parts when the strip 14 is pulled. One of said parts can be easily used to protect the product 2 while eating it.

I claim:

1. Tubular container, particularly for food products, comprising a portion of sheet material having an inner surface arrangeable in contact with a related product, two longitudinal edges and two transversal edges, a layer of adhesive material applied over bands of said inner surface which extend along each of said edges, an intermediate band of said inner surface, and a tear-strip which extends in contact with said intermediate band of said inner surface transversely to said longitudinal edges, said sheet being folded so as to bring into mutual contact said bands of said inner surface which are arranged along the longitudinal edges, with the interposition of an end portion of said strip which extends through said longitudinal edges, and said bands of the inner surface which are arranged along the transverse edges, wherein said adhesive material is a cold-adhesive material, a first further layer of cold-adhesive material coating a first surface of said tear-strip which faces said inner surface, and a second further layer of cold-adhesive material coating at least one portion of a second surface of said tear-strip which is opposite to said first surface, said portion of said second surface extending along said end portion of said tear-strip, said tear-strip being secured to said intermediate band for allowing to divide said container into two parts, a part of which must remain intact for protecting said related product until eaten.

2. Container according to claim 1, wherein a layer of cold adhesive material is applied on said intermediate band of said inner surface which is arranged in contact with said first surface of said tear-strip.

3. Container according to claim 1, wherein said tear-strip has a length which is at least equal to a distance comprised between an inner edge of one of said two bands which extend along said longitudinal edges and the longitudinal edge which is opposite to said band.

* * * * *